United States Patent [19]

Pucci

[11] Patent Number: 4,645,275

[45] Date of Patent: Feb. 24, 1987

[54] PORTABLE CARRYING CASE AND SOUND SHIELD FOR A PRINTER WITH A SELF-CONTAINED SUPPORT STAND

[76] Inventor: Philip D. Pucci, 12912 W. Graham St., New Berlin, Wis. 53151

[21] Appl. No.: 625,726

[22] Filed: Jun. 28, 1984

[51] Int. Cl.[4] ..... A47B 83/04

[52] U.S. Cl. ..... 312/244; 312/208; 312/241; 312/277

[58] Field of Search ..... 400/690.1, 690.2, 690.3, 400/690.4; 312/208, 244, 277, 240, 241; 108/23; 206/45, 34, 592, 523, 521; 232/43.1, 43.4; 190/11, 112

[56] References Cited

U.S. PATENT DOCUMENTS

| | | | |
|---|---|---|---|
| 831,766 | 9/1925 | Bing | 248/461 |
| 1,280,619 | 10/1918 | Leick | 312/277 |
| 1,566,372 | 12/1925 | Campbell | 400/690.4 |
| 1,609,435 | 12/1926 | Smith | 400/690.2 |
| 2,566,954 | 9/1951 | Murray | 312/277 |
| 3,478,996 | 11/1969 | Gunn | 248/461 |
| 3,901,372 | 8/1975 | Denley | 312/208 |
| 4,058,355 | 11/1977 | Stahl et al. | 312/241 |
| 4,067,422 | 1/1978 | Eberle | 190/112 |
| 4,252,453 | 2/1981 | Estabrooks | 400/690.1 |
| 4,345,803 | 8/1982 | Heck | 312/208 |

FOREIGN PATENT DOCUMENTS

| | | | |
|---|---|---|---|
| 2706209 | 8/1978 | Fed. Rep. of Germany | 400/690.4 |

*Primary Examiner*—Kenneth J. Dorner
*Assistant Examiner*—Joseph Falk
*Attorney, Agent, or Firm*—Andrus, Sceales, Starke & Sawall

[57] ABSTRACT

A portable carrying case for a printer of a computer system that doubles as an acoustical enclosure and may be converted into a printer stand. The case includes a base and removable cover which are both padded with urethane foam to protect the printer while being carried and to reduce noise during printing. The cover and base also include slots for accommodating bottom or back feed printers. A frame is contained within the base and is removable to elevate the case to convert it into a printer stand.

4 Claims, 3 Drawing Figures

PORTABLE CARRYING CASE AND SOUND SHIELD FOR A PRINTER WITH A SELF-CONTAINED SUPPORT STAND

BACKGROUND OF THE INVENTION

The present invention relates to supports, and more particularly to a portable carrying case for a printer of a computer system that doubles as an acoustical enclosure and may be converted into a printer stand.

Computer systems consisting of a cathode ray tube display screen, a keyboard and a printer are widely used in various industries. In the conventional assembly at a work station, the display screen is positioned immediately above and to the rear of the keyboard with the printer located adjacent the screen and keyboard.

Numerous products are known for (1) supporting a printer to allow for bottom or back feeding of paper, (2) enclosing a printer to reduce noise and (3) carrying a printer to provide portability. For example, stands that elevate the printer are known for accommodating bottom feed printers as well as back feed printers. Also acoustical enclosures or sound covers may be employed to reduce the noise created by a printer while printing. Finally, numerous types of carrying cases lined with foam are known that provide devices for carrying and protecting a printer. Each of these devices, however, suffers from lack of versatility. In other words, each device is designed only for a single purpose and none of these devices function simultaneously as a carrying case, a printer stand and an acoustical enclosure.

SUMMARY OF THE INVENTION

A portable carrying case for a printer used with computer systems which doubles as a sound shield and includes a self-contained support stand. The case provides a device to carry, protect and camouflage a printer while at the same time it is lined with a sound absorbing material to reduce noise while printing. The case also can be converted to a stand for elevating the printer to accommodate both bottom or back feed printers. The device thus functions as a carrying case, an acoustical enclosure, and a stand for a computer printer.

The device includes a base and a removable cover hinged to the base. Both the base and cover are lined with sound dampening material such as urethane foam to provide a means for reducing noise during printing and a means for protecting the printer while being carried. The base includes a bottom slot and the cover includes a rear slot so that the device can accommodate both bottom and back feed printers without removing the printer from the device. The cover includes a transparent window which allows observation of the printout during printing. The cover further includes an opaque member which slides to cover the window and camouflage the printer while it is being carried. The base also includes a rear slot for accommodating the power cord and computer interface data cable.

The device includes a self-contained support stand that elevates the printer to permit paper feed through the bottom slot in the base. The printout may then fan fold out the rear slot in the cover. The support stand includes a framework having a plurality of legs. The stand is removable from the interior of the base and positionable beneath the base to elevate the base off a work surface to allow straddling of the paper supply.

BRIEF DESCRIPTION OF THE DRAWINGS

The drawing illustrates the best mode presently contemplated of carrying out the invention.

In the drawings.

DESCRIPTION OF THE PREFERRED EMBODIMENT

Figure 1:
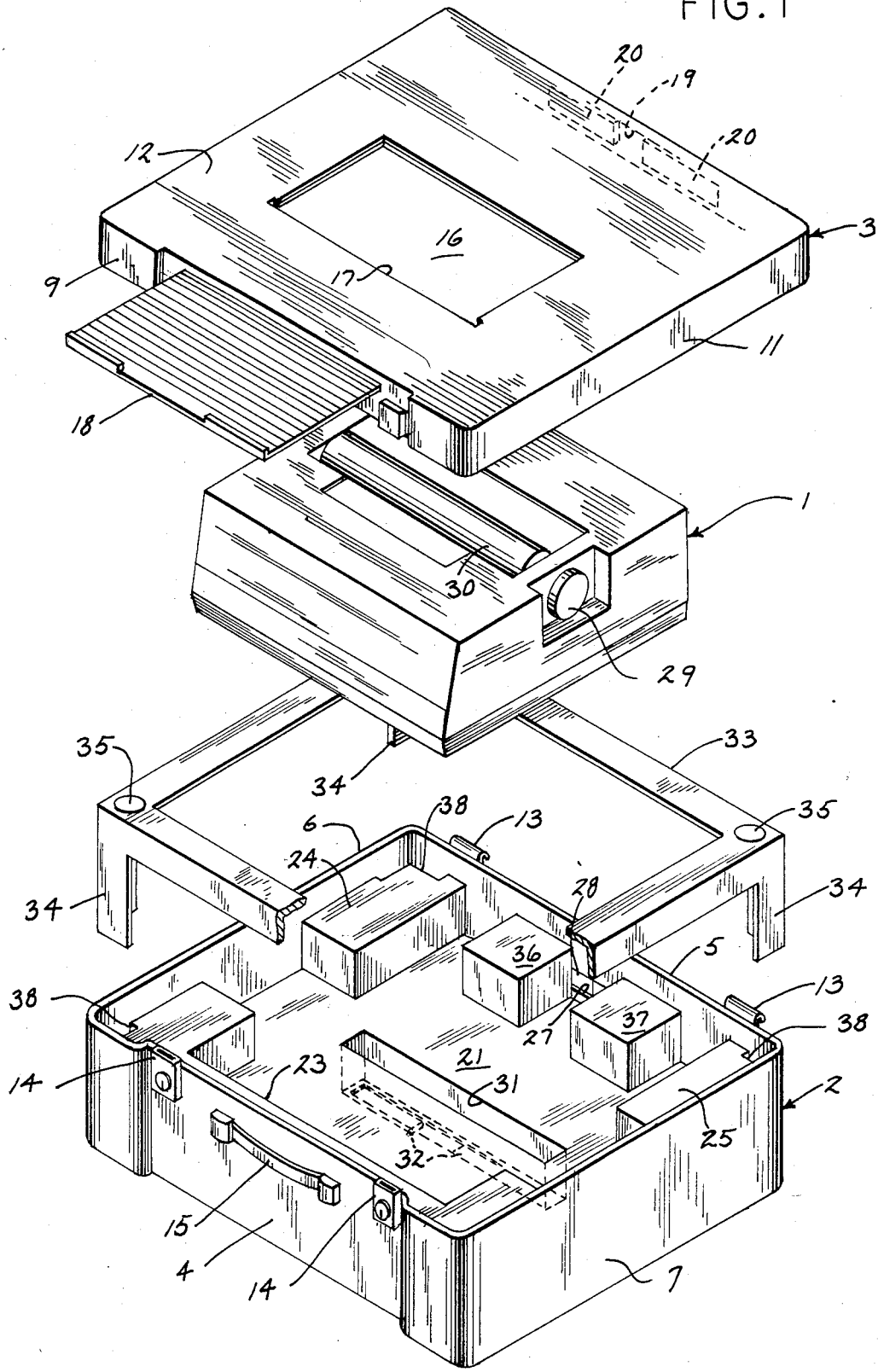
FIG. 1 is a front perspective exploded view with parts broken away of a case for a printer of a computer system constructed in accordance with the principle of the present invention.
Figure 2:
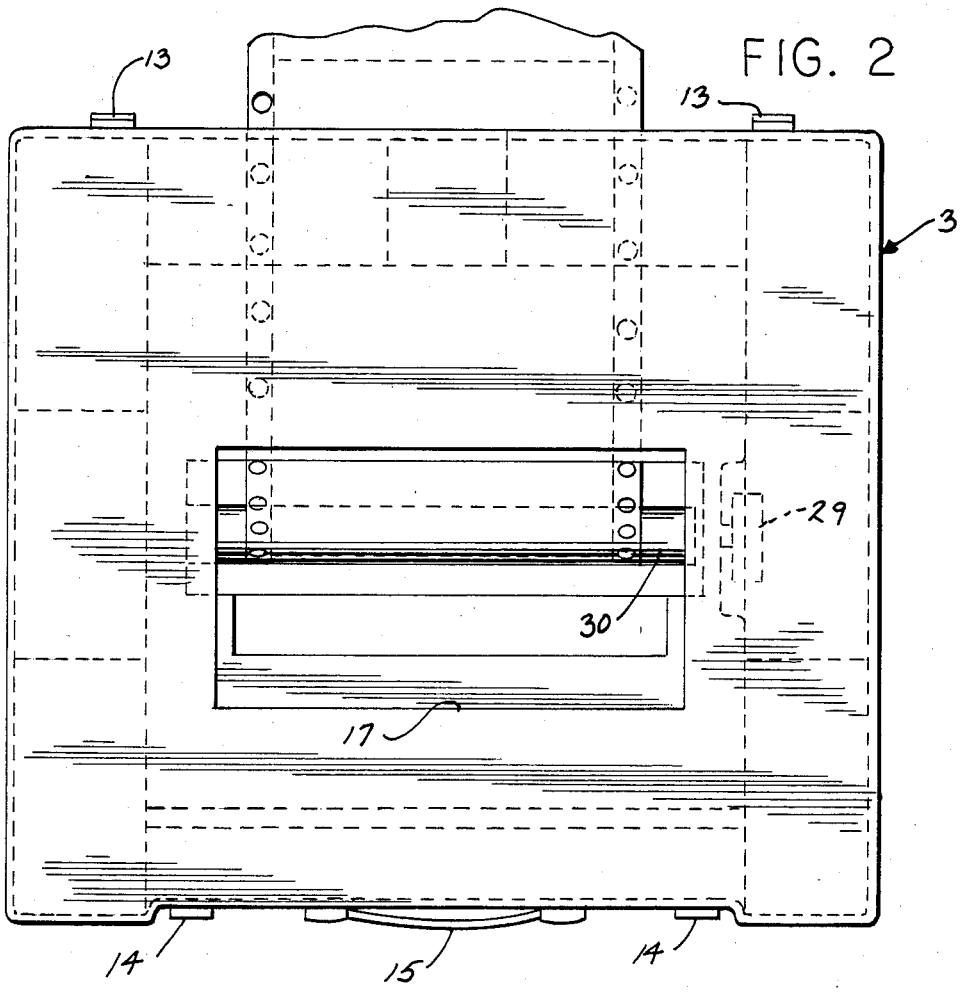
FIG. 2 is a top view of the case.
Figure 3:
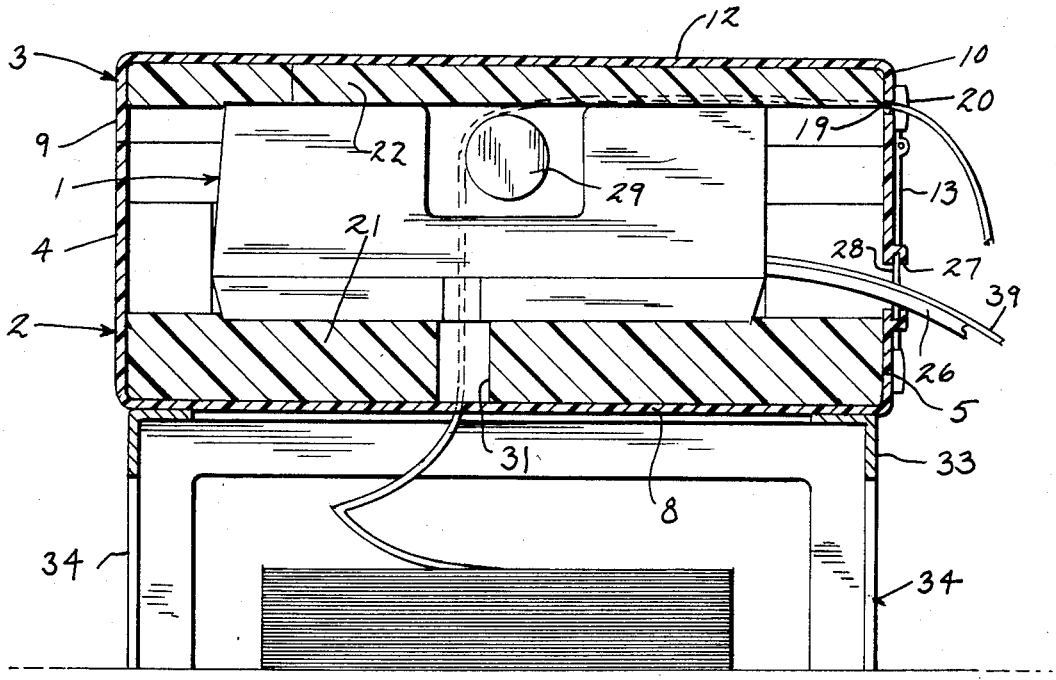
FIG. 3 is a side view in elevation showing the case converted to a bottom feed printer stand.

Referring now to the drawings, FIGS. 1–3 illustrate a portable carrying case for a printer, designated by the numeral 1, of a computer terminal. Printer 1 is shown for illustrative purposes only and is typically an 80 column, dot matrix printer. However, the carrying case of the present invention is readily adaptable to printers of various sizes and configurations.

The carrying case includes a base 2 and a removable cover 3. Base 2 and cover 3 may be composed of high density polyethylene, impact resistant ABS (acrylonitrile-butadiene-styrene) or any other material of sufficient durability and strength. Base 2 includes a front wall 4, a rear wall 5 and a pair of opposite side walls 6 and 7 interconnecting walls 4 and 5. A bottom wall 8 (see FIG. 3) interconnects the lower edges of walls 4–7.

Cover 3 includes a front wall 9, a rear wall 10, and a pair of opposite side walls 11 (only one of which is shown). A top wall 12 interconnects walls 9–11 at their upper edges. Cover 3 is removably attached to base 2 by means of hinges 13 along rear wall 5 and may be locked to base 2 by means of a pair of latches 14 on front wall 4. A carrying handle 15 is also disposed on front wall 4 so that when cover 3 is closed and locked to base 2 printer 1 is completely contained therein and may be readily carried about. The case may be 20 inches long, 18 inches wide and 8 inches in height although these dimensions may vary depending upon the size of printer 1.

As a means for viewing or observing the printout of printer 1 during printing, cover 3 includes a transparent window 16 comprised of material such as transparent acrylic disposed within a rectangular shaped opening 17 formed in top wall 12. An opaque member 18 is slidably disposed within top wall 12 and movable between an open position wherein printer 1 may be observed, and a closed position which covers window 16 and camouflages printer 1. Cover 3 also includes a slot 19 formed in its rear wall 10. Slot 19 is about 9 or 10 inches in length and thus is sufficient to accommodate the width of a sheet of paper although this may very depending on the size of the printer. Slot 19 functions to provide a paper feed opening to printer 1 as well as a printout exit opening for rear feed type printers. Slot 19 may be covered by a pair of sliding doors 20 which slide in opposite directions outwardly toward side walls 11 to open slot 19 and converge upon each other inwardly to close slot 19.

As a means for absorbing the noise created by printer 1, base 2 and cover 3 are lined with a sound deadening material such as two pound density urethane or polyester foam. As shown best in FIG. 3, base 2 has a foam layer 21 adjacent bottom wall 8, and cover 3 has a foam layer 22 adjacent top wall 12. Both layers 21 and 22 are coextensive with the dimensions of walls 8 and 12. Additionally, base 2 includes a plurality of spaced foam blocks of various dimensions that are positioned to provide a central printer receiving cavity in base 2. Block 23 is U-shaped and extends along front wall 4 and the front portion of each side wall 6 and 7. Blocks 24 and 25 are both rectangular in shape and are positioned in the rear corners of base 2. Blocks 36 and 37 are in the shape of cubes and are positioned along rear wall 5. Blocks 36 and 37 are spaced from blocks 24 and 25 and from each other along rear wall 5 to provide an opening which permits a power cord 26 and computer/printer interface data cable 39 to exit through a slot 27 formed in rear wall 5 of base 2. Slot 27 need only be one or two inches long and can be opened and closed by means of a sliding door 28. Blocks 24 and 25 are also spaced from block 23 providing openings adjacent side walls 6 and 7 for receiving knobs 29 of printer platen 30, as best shown in FIG. 2. Blocks 23–25 and 36–37 are composed of the same foam material as layers 21 and 22 and may be die cut into the appropriate shape and adhesively attached to layer 21. Layers 21 and 22 as well as blocks 23–25 and 36–37 function not only as a sound absorbtion means, but also as a means for protecting printer 1 from accidental damage while being carried due to the resilient nature of the foam.

As shown best in FIGS. 1 and 3, a slot 31 is formed through bottom wall 8 and foam layer 21 of base 2. Slot 31 provides a means for bottom feeding paper to printer 1 in those types of printers in which bottom feeding is possible. Therefore, slot 31 is approximately 9 inches in length and one inch in width. When not in use, slot 31 may be closed by a pair of slidable doors 32 similar to the doors 20 and 28.

As a means for converting the device from a carrying case to a printer stand, base 2 includes a support having a rectangular open frame 33 and four legs 34 extending downwardly from the corners of frame 33. The support may be constructed of plastic or metal angle members and is dimensioned to fit within base 2 so that the top of frame 33 is flush with the top edges of walls 4–7 with legs 34 slidably receivable within L-shaped slots 38 formed in the corners of blocks 23, 24, and 25. Pads 35 are located on the top surface of the four corners of framework 33. Pads 35 function as a means for preventing damage to the outside surface of bottom wall 8 as well as a means to prevent base 2 from sliding off the support.

A portable carrying case for a printer that doubles as a sound enclosure and includes a self-contained support stand has been illustrated and described. Various modifications and/or substitutions of the specific components described herein may be accomplished withtout departing from the scope of the invention. For example, various types of hinges, latches, handles, windows, slides, doors, etc. may be included with the device.

Various modes of carrying out the invention are contemplated as being within the scope of the following claims particularly pointing out and distinctly claiming the subject matter which is regarded as the invention.

I claim:

1. A portable carrying case for a printer of a computer terminal or the like, comprising:

a base including resilient foam means for absorbing sound emitted from a printer and for protecting the printer from damage, said foam means defining a printer-receiving cavity therein;

a cover removably attachable to said base for enclosing said cavity in a closed position, said cover including a transparent window formed therein;

opaque means on said cover movable between an open position which uncovers said window and a closed position which covers said window; and support means movable between a first storage position within said base and a second operative position outside said base, said support means includes an open frame member and a plurality of legs extending therefrom that surrounds the printer when in its storage position and supports the base and printer in an elevated position from a substantially horizontal surface upon which said support means rests while providing a means to store paper beneath said base when in said second operative position.

2. The carrying case of claim 1, wherein said base includes a bottom wall having a paper feed slot formed therethrough, and means for opening and closing said paper feed slot.

3. The carrying case of claim 2, wherein said cover includes a second paper feed and exit slot formed therethrough, and second means for opening and closing said second paper feed slot.

4. The carrying case of claim 3, wherein said base includes a rear wall having a third opening formed therethrough of sufficient dimensions to accommodate a power cord and computer interface cable for a printer, and third means for opening and closing said third opening.

* * * * *